US008286750B1

(12) United States Patent
Oliver

(10) Patent No.: US 8,286,750 B1
(45) Date of Patent: Oct. 16, 2012

(54) ENERGY CAPTURE AND CONTROL DEVICE

(75) Inventor: Russell Oliver, Sandy, UT (US)

(73) Assignee: O.S.S. Holdings, LLC, Murray, UT (US)

( * ) Notice: Subject to any disclaimer, the term of this patent is extended or adjusted under 35 U.S.C. 154(b) by 0 days.

(21) Appl. No.: 13/025,989

(22) Filed: Feb. 11, 2011

Related U.S. Application Data

(60) Provisional application No. 61/303,553, filed on Feb. 11, 2010, provisional application No. 61/418,285, filed on Nov. 30, 2010.

(51) Int. Cl.
*F41A 21/00* (2006.01)

(52) U.S. Cl. ..... 181/223; 89/14.4

(58) Field of Classification Search ..... 181/223; 89/14.4

See application file for complete search history.

(56) References Cited

U.S. PATENT DOCUMENTS

| | | | | | |
|---|---|---|---|---|---|
| 748,157 | A | | 12/1903 | Bouton | |
| 822,127 | A | | 5/1906 | Hufnagel | |
| 916,885 | A | | 3/1909 | Maxim | |
| 1,341,363 | A | * | 5/1920 | Fiala | 181/223 |
| 1,427,802 | A | | 9/1922 | Goodwin | |
| 1,462,158 | A | | 7/1923 | Wildner | |
| 1,736,319 | A | | 11/1929 | Maxim | |
| 1,773,443 | A | | 8/1930 | Wilman | |
| 2,514,996 | A | | 7/1950 | Faust, Jr. | |
| 3,667,570 | A | * | 6/1972 | WerBell, III | 181/223 |
| 3,693,750 | A | | 9/1972 | Takkunen | |
| 4,454,798 | A | | 6/1984 | Shea et al. | |
| 4,482,027 | A | | 11/1984 | Gould | |
| 4,501,189 | A | | 2/1985 | Brandl et al. | |
| 4,510,843 | A | | 4/1985 | Rabatin | |
| 4,530,417 | A | | 7/1985 | Daniel | |
| 4,576,083 | A | * | 3/1986 | Seberger, Jr. | 89/14.4 |
| 4,907,488 | A | | 3/1990 | Seberger | |
| 4,974,489 | A | | 12/1990 | Fishbaugh | |
| 5,010,676 | A | | 4/1991 | Kennedy | |
| 5,029,512 | A | * | 7/1991 | Latka | 89/14.4 |
| 5,036,747 | A | | 8/1991 | McClain, III | |
| 5,078,043 | A | * | 1/1992 | Stephens | 89/14.4 |
| 5,164,535 | A | | 11/1992 | Leasure | |

(Continued)

FOREIGN PATENT DOCUMENTS

GB 743111 A 11/1956

(Continued)

OTHER PUBLICATIONS

Wikipedia, Supressor, http://en.wikipedia.org/wiki/Suppressor, Retrieved Jan. 26, 2010, pp. 1-14.

(Continued)

*Primary Examiner* — Forrest M Phillips

(74) *Attorney, Agent, or Firm* — Thorpe North & Western LLP

(57) ABSTRACT

An energy capture and control device is disclosed and described. The device can include a central chamber oriented along a central axis within an outer shell, said central chamber having an inlet configured to receive a high energy material from a high energy outlet. An off axis chamber can be oriented within the outer shell in fluid communication with the central chamber. The off axis chamber can have a fluid outlet and multiple internal walls to produce a serpentine fluid pathway which dissipates energy transferred from the high energy material.

22 Claims, 10 Drawing Sheets

U.S. PATENT DOCUMENTS

| | | | | |
|---|---|---|---|---|
| 5,433,133 | A | 7/1995 | La France | |
| 5,486,425 | A | 1/1996 | Seibert | |
| 5,590,484 | A | 1/1997 | Mooney et al. | |
| 5,656,166 | A | 8/1997 | Linnersten et al. | |
| 5,661,255 | A | 8/1997 | Webb, III | |
| 5,679,916 | A | 10/1997 | Weichert | |
| 5,698,810 | A | 12/1997 | Rose | |
| 5,777,258 | A | 7/1998 | Soon | |
| 5,860,242 | A | 1/1999 | O'Neil | |
| 5,952,625 | A * | 9/1999 | Huff | 181/265 |
| 6,079,311 | A | 6/2000 | O'Quinn et al. | |
| 6,298,764 | B1 | 10/2001 | Sherman et al. | |
| 6,302,009 | B1 | 10/2001 | O'Quinn et al. | |
| 6,376,565 | B1 | 4/2002 | Dyer et al. | |
| 6,425,310 | B1 * | 7/2002 | Champion | 89/14.3 |
| 6,490,822 | B1 | 12/2002 | Swan | |
| 6,499,245 | B1 | 12/2002 | Swan | |
| 6,575,074 | B1 | 6/2003 | Gaddini | |
| 6,732,628 | B1 | 5/2004 | Coburn et al. | |
| 6,792,711 | B2 | 9/2004 | Battaglia | |
| 6,796,214 | B2 * | 9/2004 | Hausken et al. | 89/14.4 |
| 6,959,509 | B2 | 11/2005 | Vais | |
| 7,000,547 | B2 | 2/2006 | Amick | |
| 7,036,259 | B2 | 5/2006 | Beretta | |
| 7,059,233 | B2 | 6/2006 | Amick | |
| 7,131,228 | B2 | 11/2006 | Hochstrate et al. | |
| 7,207,258 | B1 * | 4/2007 | Scanlon | 89/198 |
| 7,216,451 | B1 | 5/2007 | Troy | |
| 7,237,467 | B1 | 7/2007 | Melton | |
| 7,308,967 | B1 * | 12/2007 | Hoel | 181/223 |
| 7,325,474 | B2 | 2/2008 | Yoshimura et al. | |
| 7,353,740 | B1 | 4/2008 | Hoffman | |
| 7,412,917 | B2 * | 8/2008 | Vais | 89/14.4 |
| 7,587,969 | B2 | 9/2009 | Silvers | |
| 7,610,710 | B2 | 11/2009 | Brittingham | |
| 7,661,349 | B1 | 2/2010 | Brittingham | |
| 7,676,976 | B2 | 3/2010 | Dueck et al. | |
| 7,707,762 | B1 | 5/2010 | Swan | |
| 7,823,314 | B1 | 11/2010 | Wheatley | |
| 7,905,319 | B2 * | 3/2011 | Sullivan | 181/250 |
| 7,987,944 | B1 * | 8/2011 | Brittingham et al. | 181/223 |
| 2007/0107982 | A1 * | 5/2007 | Sullivan | 181/249 |
| 2007/0256347 | A1 | 11/2007 | Fitzpatrick et al. | |
| 2009/0235568 | A1 | 9/2009 | Auvine | |
| 2010/0048752 | A1 | 2/2010 | Vignola et al. | |
| 2010/0199834 | A1 | 8/2010 | Dueck et al. | |

FOREIGN PATENT DOCUMENTS

| | | | |
|---|---|---|---|
| GB | 2287780 | A | 9/1995 |
| GB | 2288007 | A | 10/1995 |
| WO | WO-99/02826 | | 1/1999 |

OTHER PUBLICATIONS

"JBU 6.5 inch Modular Silencer and Flash Hider System". Web. Apr. 6, 2011. http://www.airsoftatlanta.com/JBU__6__5__inch__Modular__Silencer__and__Flash__Hider__p/52319.htm.

"3.5 MSS (Modular Suppressor System)—(Barrel Extension) by JBU—Airsoft Guns | Trinity Airsoft". Web. Apr. 7, 2011. http://www.trinityairsoft.com/p-1451-35-mss-modular-suppressor-system-barrel-extension-by-jbu.aspx.

Oliver, Russell, U.S. Appl. No. 61/418,311 entitled "Coupling Device, System, and Methods to Maintain Relative Positions Between Two Components", filed Nov. 30, 2010.

Oliver, Russell, U.S. Appl. No. 13/025,954, filed Feb. 11, 2011.

Oliver, Russell, U.S. Appl. No. 13/025,941, filed Feb. 11, 2011.

Oliver, Russell, U.S. Appl. No. 13/025,973, filed Feb. 11, 2011.

U.S. Appl. No. 13/025,973, filed Feb. 11, 2011, Russell Oliver, office action issued Oct. 3, 2011.

* cited by examiner

ENERGY CAPTURE AND CONTROL DEVICE

RELATED APPLICATIONS

Priority is claimed to U.S. Provisional Patent Application Ser. No. 61/303,553, filed on Feb. 11, 2010, and U.S. Provisional Patent Application Ser. No. 61/418,285, filed Nov. 30, 2010, which are each hereby incorporated herein by reference.

BACKGROUND

High energy sources can produce undesirable levels of acoustic noise and/or particulate pollution. Frequent exposure to high levels of acoustic noise can cause permanent or temporary hearing loss. Furthermore, in the case of firearms discharge, such acoustic noise can also provide information as to location of a shooter.

In many counter-terrorism efforts, snipers will attempt to conceal their location from terrorists and others using various sound suppression devices. However, muzzle blast, projectile shock waves, and particulate discharge associated with firing a weapon can enable terrorists to determine a range and direction of the sniper. For example, where both blast and shock waves can be detected and properly processed, existing technologies can enable terrorists to determine the direction and range of incident fire without even having to survey and look for sources of fire. Projectile speeds, trajectories, miss distances, and so forth can also be used as input to determine a position of a sniper.

In the field of firearm sound suppression, basic sound suppression technology has varied only modestly over the past hundred years. However, as described above, terrorists' ability to pinpoint a sniper's location has increased dramatically. The possession of such technology by terrorist cells can substantially undermine counter-terrorism efforts.

Generally, sound suppression designs are based on internal baffles which direct gases into vortices or other flow patterns with optional expansion chambers. Although these designs provide suppression of sound from firearm discharge, there is still a substantial decibel level produced when using these devices. Those designs which reduce sounds to a higher degree also tend to have a lower useful lifespan. Many of the current high-end designs utilize a sound absorbing fluid such as oil or water in the device. Such fluids must be periodically replaced (e.g. every few shots) and can be vaporized and distributed into the air upon discharge of the firearm. Therefore, despite some advantageous performance of these devices, many challenges still remain in achieving a long service life suppressor with low maintenance requirements and high acoustic suppression performance.

Figure 1A:
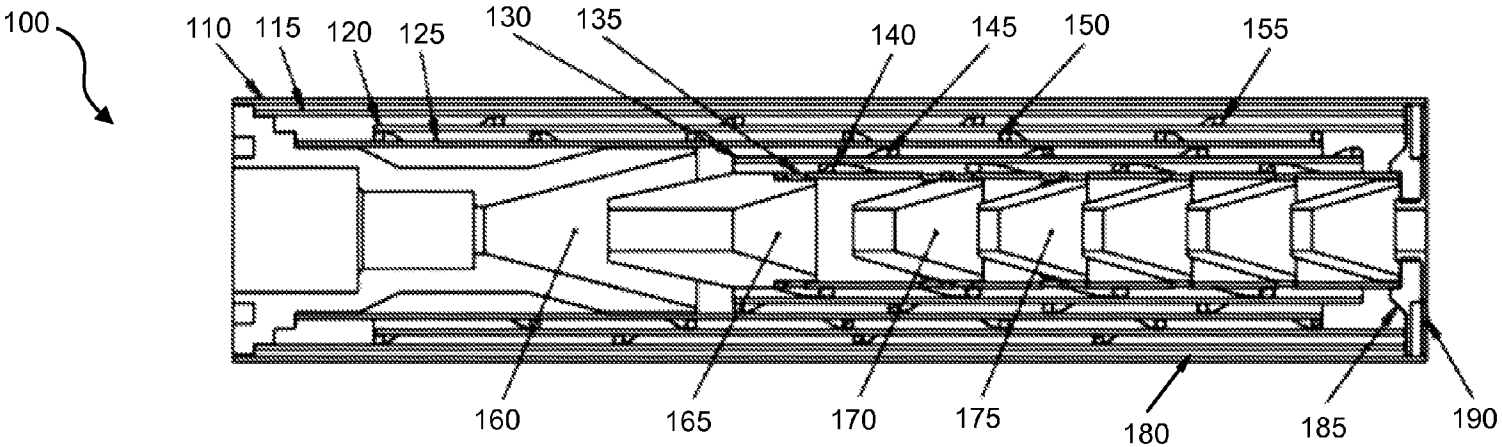
FIG. 1*a* is a cross-sectional side view of a device having multiple concentric tubes, a helical wall, and series of deflectors in accordance with an example of the present technology.

These figures are provided for convenience in describing the following aspects. In particular, variation may be had in dimensions, materials, configurations and proportions from those illustrated and not depart from the scope of the invention.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

DEFINITIONS

In describing and claiming the present invention, the following terminology will be used.

The singular forms "a," "an," and "the" include plural referents unless the context clearly dictates otherwise. Thus, for example, reference to "a tube" includes reference to one or more of such members, and reference to "directing" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of about 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Energy Capture and Control

In counter-terrorism operations, concealment of the location of firearm operators is critical to hostage rescue, terrorist apprehension, operations protection, dignitary and witness protection, intelligence gathering, and other operations. These missions are important to the successful defense of nations from terrorism. Effective energy capture and control devices for firearms can dramatically increase effectiveness and survivability of counter terrorism special forces during such operations. Increased survivability in such scenarios can also improve operator confidence and performance, and decrease collateral costs associated with injuries to highly trained operators.

An energy capture and control device can comprise a central chamber oriented along a central axis within an outer shell. The central chamber can have an inlet configured to receive a high energy material from a high energy outlet. An off axis chamber can be oriented within the outer shell in fluid communication with the central chamber. The off axis chamber can have a fluid outlet and multiple internal walls configured to produce a serpentine fluid pathway which dissipates energy transferred from the high energy material.

As illustrated in FIG. 1*a*, the energy capture and control device 100 can include a plurality of deflectors 165, 170, 175 arranged within the central chamber. The central chamber can be oriented along a central axis within an outer shell 110. The deflectors can be arranged to enable passage of a high energy material therethough while redirecting at least a portion of gases, sound/shock waves, and/or particulates into the off axis chamber.

The off axis chamber can include multiple internal walls 115, 120, 125, 130, 140, 145, 150, and/or 155 defining a serpentine or winding fluid pathway. The multiple internal walls can provide an increased volume for fluid expansion and increased acoustic absorbent path length. The fluid pathway can be an axially serpentine fluid pathway which causes fluids received in the off axis chamber to travel back and forth along a length of the off axis chamber. In another aspect, the fluid pathway can be a radially serpentine fluid pathway which causes the fluids received in the off axis chamber to flow back and forth around a radius of the off axis chamber. In another aspect, the fluid pathway can be a radially serpentine pathway which causes the fluids to flow back and forth around a radius of the off axis chamber while also traversing a length of the off axis chamber. In yet another aspect, the fluid pathway can be a helical fluid pathway which causes the fluids to spiral around the central chamber within the off axis chamber along a length of the off axis chamber. The various configurations can be integrated into various combinations as well to produce more complex flow paths.

Although the parts of the device can be formed of any suitable material, the central chamber and off axis chamber can be formed substantially of titanium. Non-limiting examples of other suitable materials can include high impact polymers, stainless steels, aluminum, molybdenum, refractory metals, super alloys, aircraft alloys, carbon steels, composites thereof, and the like. One or more of the individual components can further include optional coatings such as, but not limited to, diamond coatings, diamond-like carbon coatings, molybdenum, tungsten, tantalum, and the like can also be used. These components can be molded, machined, deposited or formed in any suitable manner. Currently, machining can be particularly desirable but is not required.

Figure 1B:
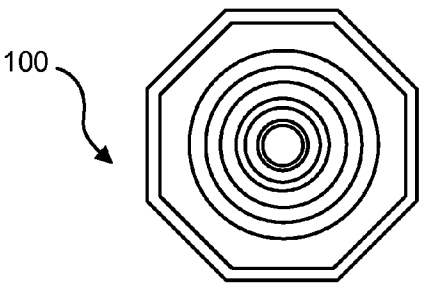
FIG. 1*b* is a cross-sectional end view of the device of FIG. 1*a;*

FIG. 1*a* illustrates an example configuration where the internal walls define an axially serpentine fluid pathway which helically spirals around the central chamber along a length of the off axis chamber. More specifically, the off axis chamber is comprised of a plurality of tubes 115, 120, 125, 130, 135 of differing diameters nested within one another. In other words, the multiple internal walls can be formed by multiple concentric tubes having progressively larger diameters so as to form annular spaces between each adjacent tube. FIG. 1*b* is a cross-sectional side view of the device of FIG. 1*a*, illustrating tubes nested within an octagonally-shaped outer shell.

Adjacent tubes define a void therebetween through which gases can flow. Each tube can have at least one inlet from a successively smaller tube (or from a deflector or other structure) to allow fluids to flow from one tube to the next. For example, the inlet in one tube may comprise a hole near a first end of the tube and the same tube may have an outlet at an opposite end of the tube. Placing a hole near the ends of the tubes will force gases along a pathway through the tube due to pressure of the gases from the high energy device discharge.

In another aspect, the concentric tubes can have ends offset from an adjacent tube so as to produce a serpentine fluid annular pathway. The multiple concentric tubes can include an innermost tube which includes orifices oriented to allow fluid to pass from the central chamber into a first annular space adjacent the innermost tube and through the annular spaces of progressively larger diameter.

One or more of the tubes can also include a rod 140, 145, 150, 155 or other device helically winding within the tube to define a helical pathway within the tube. The rod can be sized and shaped to fit snugly between adjacent tubes to force gases along a desired path. In one aspect, the rod can be permanently attached to at least one of the tubes. In another aspect, the off axis chamber may comprise five separate tubes, an innermost tube defining the central chamber. Four helical rods can be arranged within the voids between the tubes to define helical pathways in each of the tubes along an entire length of the energy capture device.

The central chamber can further comprise a locking block 160 oriented at the inlet. The locking block can have an engagement surface configured to attach to the high energy outlet and a hollow interior along the central axis, said hollow interior having a reducing throat portion and a flared outlet.

In one aspect, the engagement surface can include a male component and a female component. For example, the engagement surface may comprise a coupling device which is threaded to enable threaded coupling of the shell 110 to the high energy discharge device. The threaded coupler can include a male component or a female component. In another more specific example, the threaded coupler can have helical threads rotating in an opposite direction as rifling in the high energy discharge device. Having the coupler threads rotate in an opposite direction as the rifling will result in torque on the energy control device 100 from the spin of the bullet which tightens the threaded coupling of the energy control device to the high energy discharge device.

Various other types of coupling mechanisms may be used to couple the particulate capture module to a high energy discharge device or other modular attachment to a high energy discharge device. For example, the energy control device can be a modular attachment to enable selective sound suppression in the field. The ends of the energy control device can include an engagement or coupling mechanism to secure modules to one another and/or to a firearm when desired. The coupling device can maintain a relative position between the shell and the high energy discharge device. Non-limiting examples of suitable engagement mechanisms can include threaded engagement, recessed locking, interference fit, detent locking, and the like. The modular design can be subdivided into additional sub-modules as desired and reassembled to provide function individually or assembled. In a more specific aspect, the coupling device includes a first coupling member having a first catch and a first alignment surface. A second coupling member can have a second catch and a second alignment surface. A resilient component can be associated with the second coupling member and can resiliently deflect upon engagement with the first catch when joining the first coupling member and the second coupling member. Engagement with the first catch can resist release of the first coupling member and the second coupling member. The first catch and the second catch can interface to maintain a relative position along a first axis and the first alignment surface and the second alignment surface interface to maintain a relative position along a second axis orthogonal to the first axis.

As described above, the locking block can be arranged adjacent to a deflector within the central chamber of the device. In another aspect, the central chamber may further comprise a plurality of deflectors 165, 170, 175 oriented in series along the central axis. A variety of specific contours and deflector shapes can be used. In one aspect, the plurality of deflectors can be frustoconical having a hollow interior along the central axis and each having a flared exit portion as illustrated in FIG. 1*a*. The embodiment shown in FIG. 1*a* illustrates a plurality of deflectors which include a primary deflector 165, a secondary deflector 170, and at least one tertiary deflector 175. However, any desired number of deflectors may be used. As shown in FIG. 1*a*, the at least one tertiary deflector can include four deflectors. The tertiary deflectors can be at least partially engaged within the flared exit portion of an adjacent deflector. In another optional aspect, the plurality of deflectors can span substantially the entire central axis along the central chamber.

In another aspect, the off axis chamber can further include an annular dampening chamber 180 oriented about the central chamber and being filled with an energy absorbent material. The dampening chamber can be oriented adjacent the outer shell 110 as illustrated in FIG. 1*a*. The energy absorbent material can be any suitable acoustic impedance filter. Generally, the material can absorb and/or deflect acoustic waves back toward the bullet path. In one aspect, the energy absorbent material is a dry material. Non-limiting examples of suitable material can include powder tungsten filament, metal powder, graphite, polymer, and the like. In one aspect the material can be a powder tungsten filament or other heavy metal or metal powders (e.g. aluminum, stainless steel, carbon steels, iron, copper, tantalum, titanium, vanadium, chromium, zirconium, carbides of these, alloys of these, and the like). Although fluids could be used (e.g. oil, water etc.) these are generally not needed and can be conveniently omitted without loss of performance. This dampening chamber can be used in connection with or without the axially serpentine fluid pathway or the plurality of deflectors. The energy absorbent material can also be optionally introduced into other chambers within the device. For example, the energy absorbent material can be particularly beneficial when placed in one or more annular spaces intermediate between the central axis and the outer shell. In one aspect, a tapered annular space exists between the locking block throat and the adjacent tube (i.e. tube 125).

In some applications a modular system can be desirable to allow for adjustable acoustic suppression in the field. For example, the device can be modularized along the central axis to form at least two detachable portions. In one aspect, the chamber can be divided between the secondary and tertiary deflectors of FIG. 1*a* and capped at the junction on each corresponding end. The ends can include an engagement mechanism to secure the modules together when desired. Non-limiting examples of suitable engagement mechanisms can include threaded engagement, recessed locking, interference fit, detent locking, and the like. The modular design can be sub-divided into additional sub-modules as desired and reassembled to provide function individually or assembled.

Figure 2:
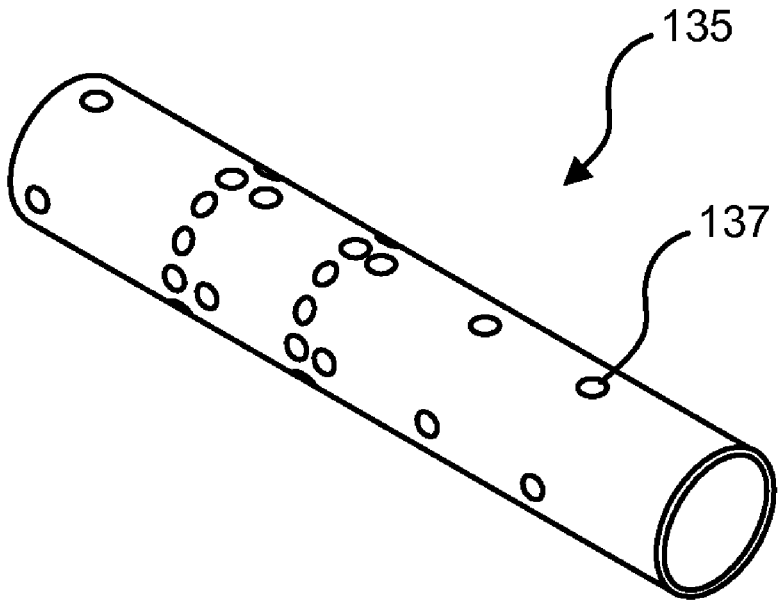
FIG. 2 is a perspective view of an innermost tube having apertures to allow fluids to flow from the central chamber into the off axis chamber in accordance with an example of the present technology.

An innermost tube 135 in the off axis chamber can include orifices which correspond to the plurality of deflectors. One configuration of an innermost tube is shown in FIG. 2. Orifices 137 can be varied in location, size and number for individual designs. In one aspect, the holes can oriented adjacent a contact point between a deflector and an inner wall of the innermost tube.

Figure 3A:
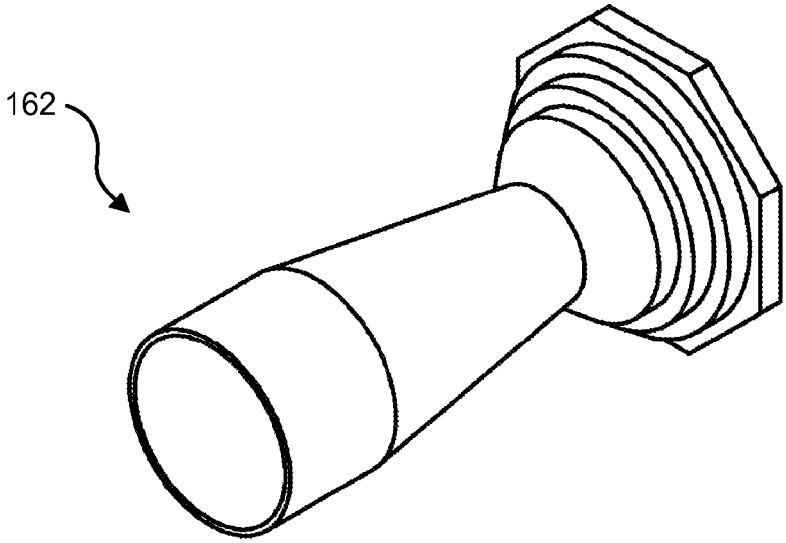
FIG. 3*a* is a perspective view of a locking block having a tapered throat portion in accordance with an example of the present technology.
Figure 3B:
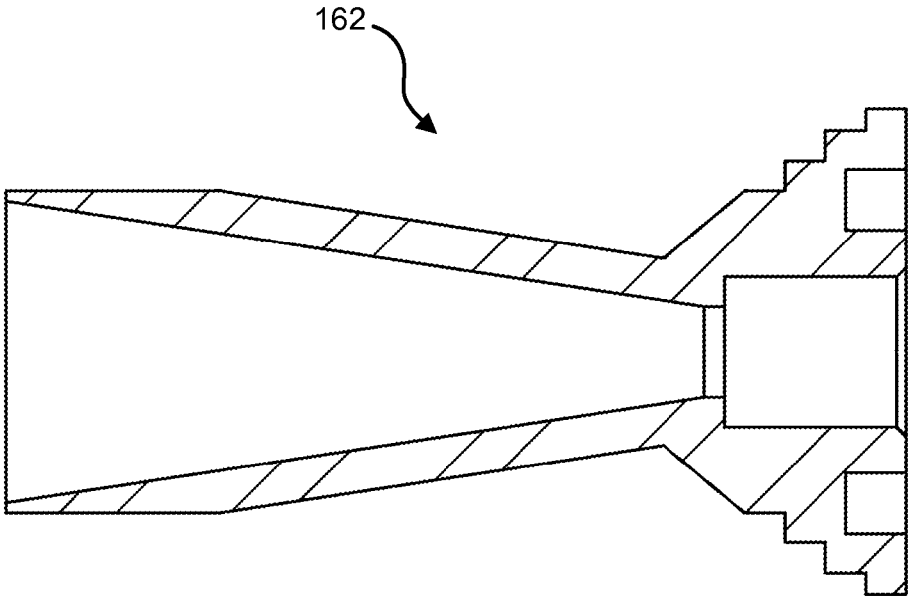
FIG. 3*b* is a cross-sectional side view of the locking block of FIG. 3*a;*
Figure 4A:
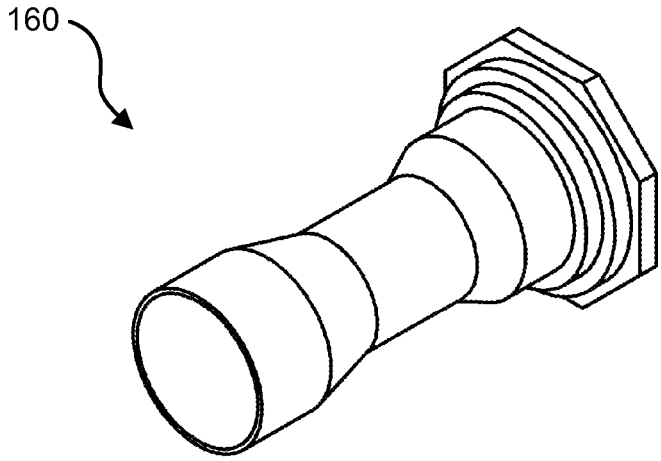
FIG. 4*a* is a perspective view of a locking block having a tapered throat portion with an intermediate throat portion in accordance with an example of the present technology.
Figure 4B:
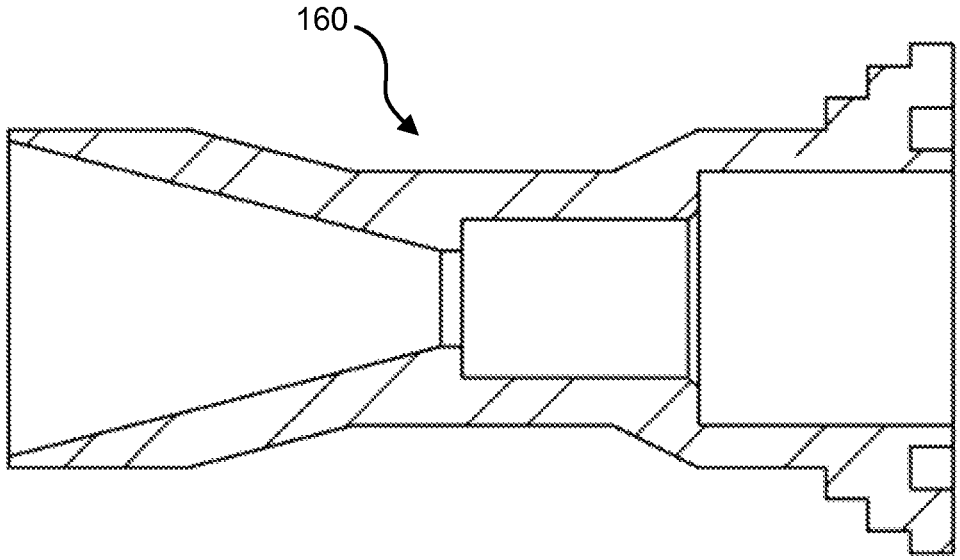
FIG. 4*b* is a cross-sectional side view of the locking block of FIG. 4*a;*
Figure 5A:
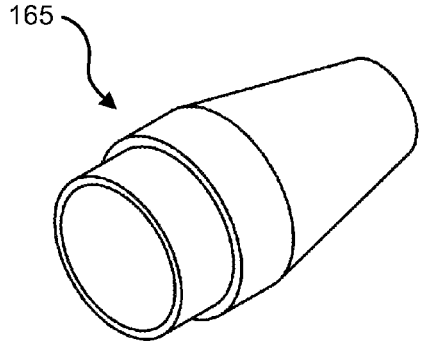
FIG. 5*a* is a perspective view of a primary chamber in accordance with an example of the present technology.
Figure 5B:
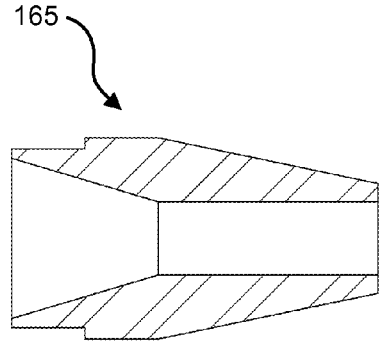
FIG. 5*b* is a cross-sectional side view of the primary chamber of FIG. 5*a;*
Figure 6A:
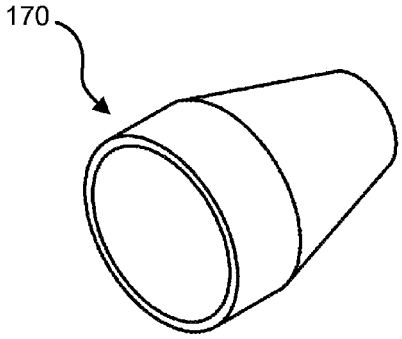
FIG. 6*a* is a perspective view of a primary chamber in accordance with an example of the present technology.
Figure 6B:
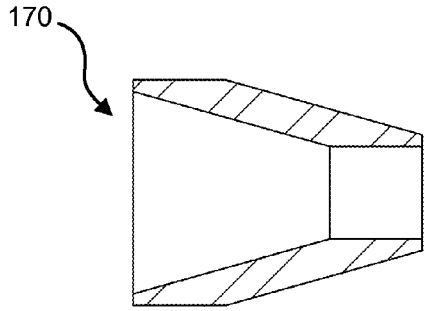
FIG. 6*b* is a cross-sectional side view of the primary chamber of FIG. 6*a;*
Figure 7A:
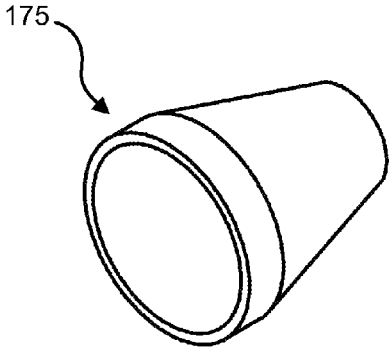
FIG. 7*a* is a perspective view of a primary chamber in accordance with an example of the present technology.
Figure 7B:
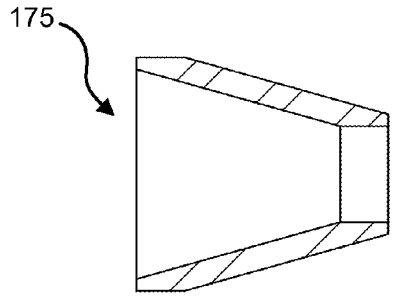
FIG. 7*b* is a cross-sectional side view of the primary chamber of FIG. 7*a;*

FIGS. 3*a*-4*b* illustrate configurations for locking blocks 160, 162 for attaching the energy capture device to the high energy outlet of a high energy discharge device. The locking blocks include hollow interiors along the central axis. The hollow interiors in one aspect can have an inlet chamber, a reducing throat portion, and a flared outlet. FIG. 3 and FIG. 4 illustrate two optional configurations for a locking block. One difference between FIGS. 3 and 4 is that FIG. 4 includes a middle chamber between the inlet chamber and the flared outlet. The middle chamber can have a different diameter than the inlet chamber. The staging of chambers of differing diameters can assist in sound reduction by providing additional space for acoustic waves, pressures, and gases to flow and reduce energy before exiting an outlet of the energy capture device.

At least one of the plurality of deflectors can be positioned adjacent to or at least partially within the flared outlet of the locking block. For example, a primary deflector may be arranged such that an inlet of the primary deflector is at least partially within the flared outlet of the locking block. Likewise additional deflectors can be adjacent to one another or at least partially nested within one another. In another aspect, one or more of the deflectors may be spaced from another deflector or the locking block such that the deflector is not adjacent or nested within a nearby deflector or locking block.

FIGS. 5*a*-7*b* illustrate different configurations for deflectors. For example, the figures illustrate frustoconically shaped deflectors 165, 170, 175 having hollow interiors along a central axis and a flared exit portion. The degree of flaring, as well as specific size and shape considerations, can be varied according to application and/or positioning of a specific deflector within an energy capture device relative to other deflectors.

The deflectors and any walls, tubes, etc. in the off axis chamber can be arranged within the outer shell. The outer shell can be generally tubular and have any suitable cross-section shape. In one aspect, the outer shell has an octagonal cross-section. The outer shell can optionally have a circular cross-section or any other desired shape (e.g. 5, 6, 7, 9 or 10 sides). Optionally, the outer shell can include an end cap assembly at an outlet end of the central chamber and which allows fluid to escape from the off axis chamber. For example, the end cap assembly can include a tube cap and an end cap.

Figure 8A:
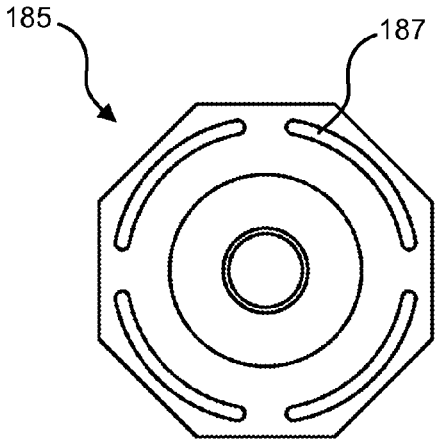
FIG. 8*a* is an end view of a tube cap in accordance with an example of the present technology.
Figure 8B:
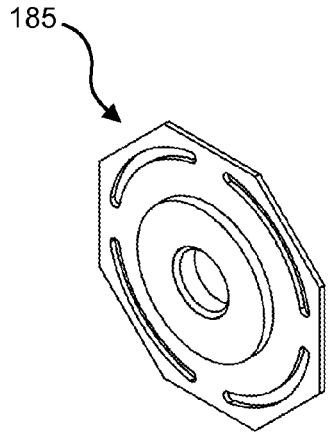
FIG. 8*b* is a perspective view of the tube cap of FIG. 8*a;*

FIGS. 8*a*-8*b* illustrate a tube cap 185 having outlet slits 187 which correspond to an outermost tube in the off axis chamber. The outlet slits can be semi-circular to correspond to a shape of the tube and to enable gases from the tube to pass therethrough. For example, where helical walls are included in the outermost tube, there is a potential for gases to be at least partially blocked from exiting the tube without a tube cap having sufficient slits to enable gases to escape regardless of orientation of the helical walls. Thus, the slits of FIGS. 8*a*-8*b* can provide a pathway for gases from the outermost tube through to an end cap.

Figure 9A:
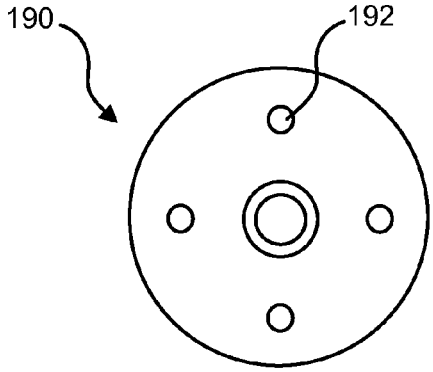
FIG. 9*a* is an end view of an end cap in accordance with an example of the present technology.
Figure 9B:
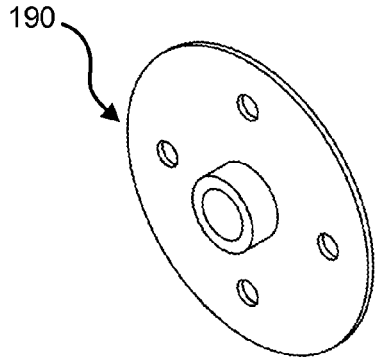
FIG. 9*b* is a perspective view of the end cap of FIG. 9*a;*

FIG. 9 illustrates an end cap 190 having exit apertures 192 offset to prevent an unobstructed exit of fluids from the off-axis chamber. Providing apertures in the end cap which are smaller than the slits, at least in one dimension, can restrict expulsion of gases, acoustic waves, and so forth from the end of the energy capture device. Completely blocking the discharge of such gases, waves, and the like, is another option, but can have increased detrimental effects on the high energy discharge device to which the energy capture device is attached. In one aspect, the end cap can include apertures of varying diameters and be rotatable with respect to the tube cap. As a result, the end cap can be rotated to adjust an amount of energy capture (i.e., sound suppression) according to a selected aperture. In this aspect, the tube cap can optionally include smaller slits or apertures such that only one size of aperture is open to the tube cap slits/apertures at any time.

Figure 10A:
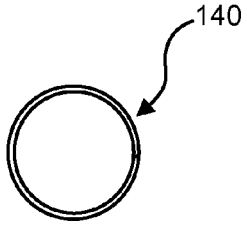
FIG. 10*a* is an end view of a helical wall in accordance with an example of the present technology.
Figure 10B:
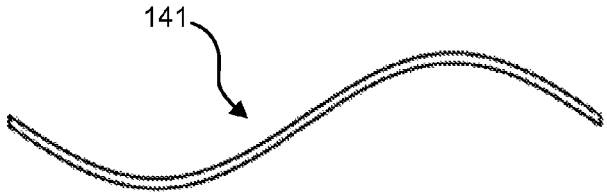
FIG. 10*b* is a side view of a single revolution helical wall in accordance with an example of the present technology.
Figure 11:
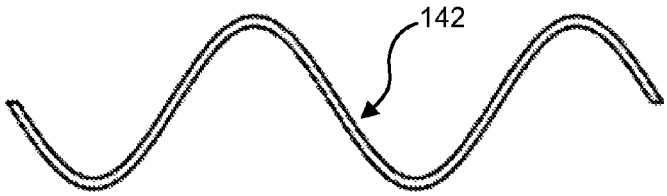
FIG. 11 is a side view of a two revolution helical wall in accordance with an example of the present technology.
Figure 12:
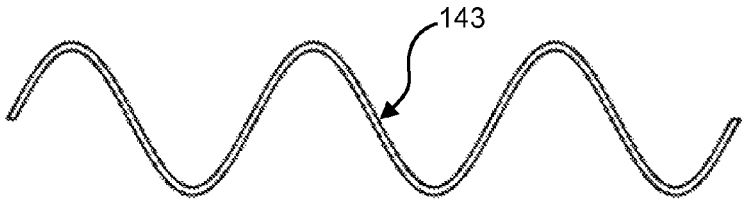
FIG. 12 is a side view of a three revolution helical wall in accordance with an example of the present technology.
Figure 13:
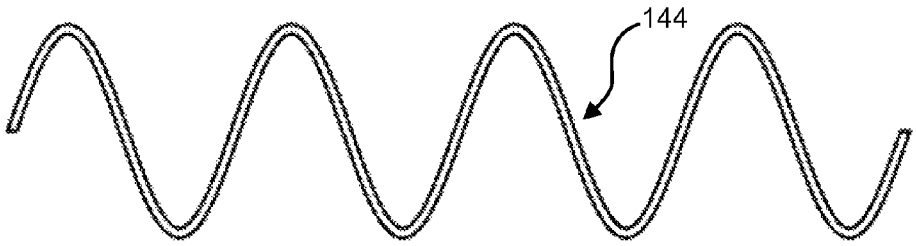
FIG. 13 is a side view of a four revolution helical wall in accordance with an example of the present technology.

As described above, one optional aspect of the device is to include a helical wall oriented within at least one of the annular spaces to direct fluids along a helical path within the at least one annular space (e.g., the off axis chamber, or alternately a space within the off axis chamber defined by one or more tubes). In one aspect all of the annular spaces which define the fluid pathway include a helical wall, and in another aspect fewer than all of the annular spaces include a helical wall. FIGS. 10*a*-13 illustrate side views of helical rods having spring-like shapes. More specifically, FIG. 10*a* illustrates an end view of a helical rod 140 which may be representative of an end view of any of the helical rods of FIGS. 10*b*-13. FIG. 10*b* illustrates a helical rod 141 which provides for a single revolution within an annular space. FIG. 11 illustrates a helical rod 142 which provides for two revolutions. FIG. 12 illustrates a helical rod 143 which provides for three revolutions. FIG. 13 illustrates a helical rod 144 which provides for four revolutions. Rods with even greater revolutions may also be used. Increasing the number of revolutions can increase a path length through the energy capture device. A single device can include multiple helical rods of same or differing revolutions.

As illustrated in FIGS. 10*b*-13, the helical walls can have varying winding ratios (i.e. windings:diameter). This winding ratio can be varied to optimize performance of the device for particular applications based on a number of variables (e.g. caliber, back pressure, etc.). The helical walls can be optionally replaceable so as to provide an adjustable tuning or to be repaired. The winding ratio can also be changed in order to control and/or adjust the energy transfer velocity and subsequent back pressure returned to the high energy outlet. This configuration can resolve or mitigate adverse effects that traditional sound suppressors may have on their host weapon. For example, 75% loss of expected life span of the weapon due to excessive PSI, rate of fire increases, excessive fouling and carbon buildup, debris returning to the operators face via the chamber of the barrel, unreliability due to combinations of these issues. These drawbacks can be largely eliminated or substantially reduced using the configurations described herein.

Generally, a higher rate of twist provides a greater path length for fluids along the fluid pathway to the chamber outlet. Although other ratios can be suitable, in one aspect, the helical wall has a winding ratio of about 3:1 to about 8:1. In one aspect, the device can include five multiple concentric tubes forming the annular spaces although other numbers of concentric tubes can be suitable. For example, pistol suppressors can sometimes utilize fewer chambers while high caliber rifles can utilize more chambers to achieve desirable sound suppression. Thus, each different diameter tube may have a different winding ratio if the number of windings is consistent within each tube. Alternately, each tube can be configured to have a substantially similar winding ratio by changing the number of windings in a specific tube according to a diameter of the tube.

Figure 14:
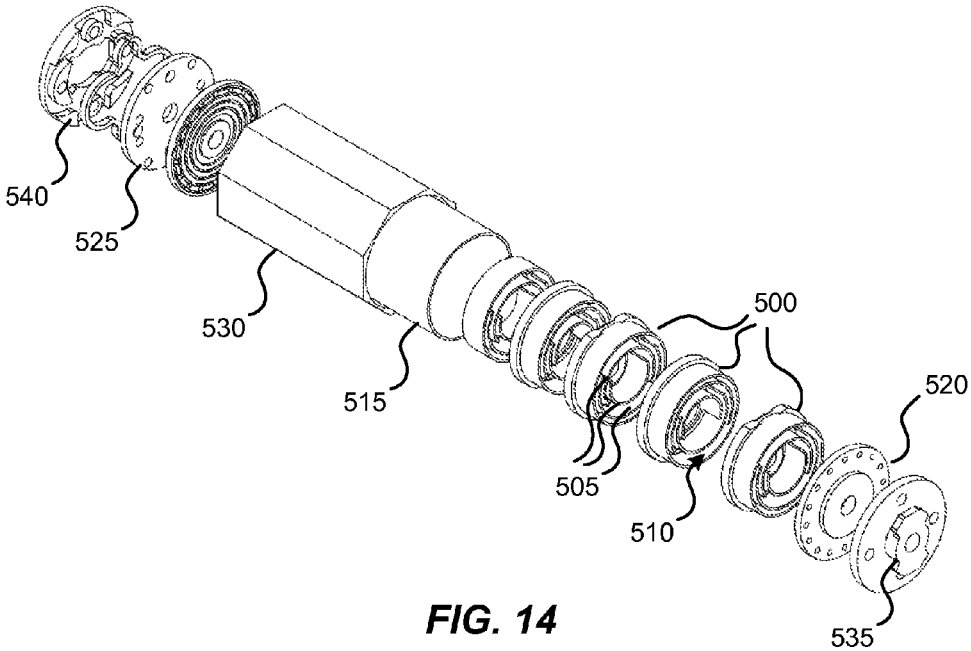
FIG. 14 is an exploded perspective view of a device having concentric incomplete cylinders which are offset in accordance with an example of the present technology.

Another alternative configuration for the internal walls to form the serpentine pathway can be concentric incomplete cylinders (i.e. the cross-section is an incomplete circle). The openings or gaps can form slits along the length of the cylinder. These gaps can be offset such that gases traveling therethrough are forced to pass through the annular space between each concentric cylinder. One example of such a configuration is shown in FIG. 14. In this configuration, the device includes multiple segments 500 which each have concentric offset cylinders 505. Gases flow into a serpentine path 510 created by the offset and spaced cylinders. The serpentine path in this case is a series of annular spaces which are connected and progressively larger. An outer shell 515 can enclose the assembly of segments and can include endpieces 520 and 525 to redirect gases which can optionally flow through the outer shell and external shell 530. Coupling mechanisms 535 and 540 can also optionally be used to secure the device to a muzzle adapter or other modular device. Such coupling can also be obtained using threaded or other suitable connectors as described herein.

Figure 15:
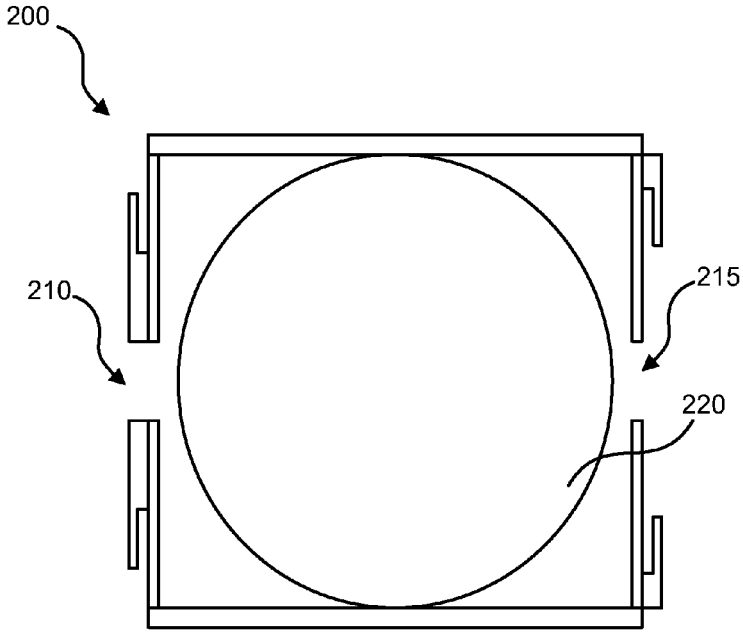
FIG. 15 is a cross-sectional side view of a particulate capture module in accordance with an example of the present technology.

In another optional aspect, a particulate modular attachment can be used to capture particulates from the high energy material as it exits the chamber. This can be particularly useful in firearm applications where the high energy material is a bullet. The particulate modular attachment 200 can have a particulate inlet 210 and a module outlet 215 defining a particulate control chamber, as shown in FIG. 15. The attachment can be configured to attach to the fluid outlet and remove particulates. In one aspect, the particulate modular attachment includes a self-healing polymeric material 220 oriented in the particulate control chamber. The self-healing polymeric material can be any suitable material such as, but not limited to, expanded polyurethane, expanded polyethylene, expanded polystyrene, ionomeric metal salt of an ethylene-vinyl copolymer, copolymers thereof, and composites thereof. In one aspect, the self-healing polymeric material is expanded polyurethane or an ionomeric metal salt. The chamber can optionally include a removable cap to allow the polymeric material to be periodically replaced. Over time, this material can lose its resiliency and/or accumulate excessive particulates sufficient to make replacement desirable.

In another aspect, the device has substantially no moving parts during operation. This can greatly improve the useful life of the device by avoiding or reducing mechanical friction and potential for part wear and/or fatigue. In one aspect, the central chamber includes a central chamber outlet along the central axis and the high energy material is a bullet. The high energy outlet in this case can be a firearm muzzle (e.g. rifle, pistol, etc).

Figure 16:
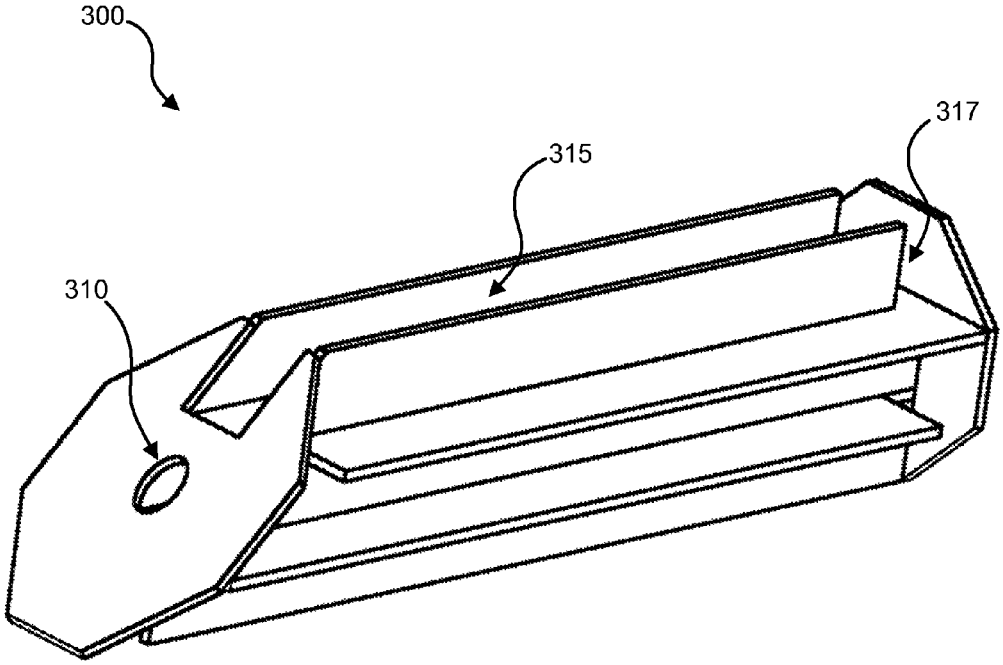
FIG. 16 is a perspective view of a device within an outer shell having longitudinal chambers which are each off set from the central axis in accordance with an example of the present technology.

FIG. 16 illustrates another optional configuration for the multiple internal walls which form a plurality of longitudinal chambers. For purposes of illustration, the outer shell shown in previous figures is not shown. The longitudinal chambers can be each off set from the central axis and fluidly connected to from the axially serpentine fluid pathway. In this case, the longitudinal chambers include a first primary chamber 315 which splits the fluid flow into two paths at the end 317. The two paths serpentine along opposing sides and then recombine at a lower common chamber (not shown, but below the primary chamber 315, and more specifically directly below the high energy material path indicated generally by inlet 310) which can then direct fluids to a chamber exit (not shown).

Figure 17:
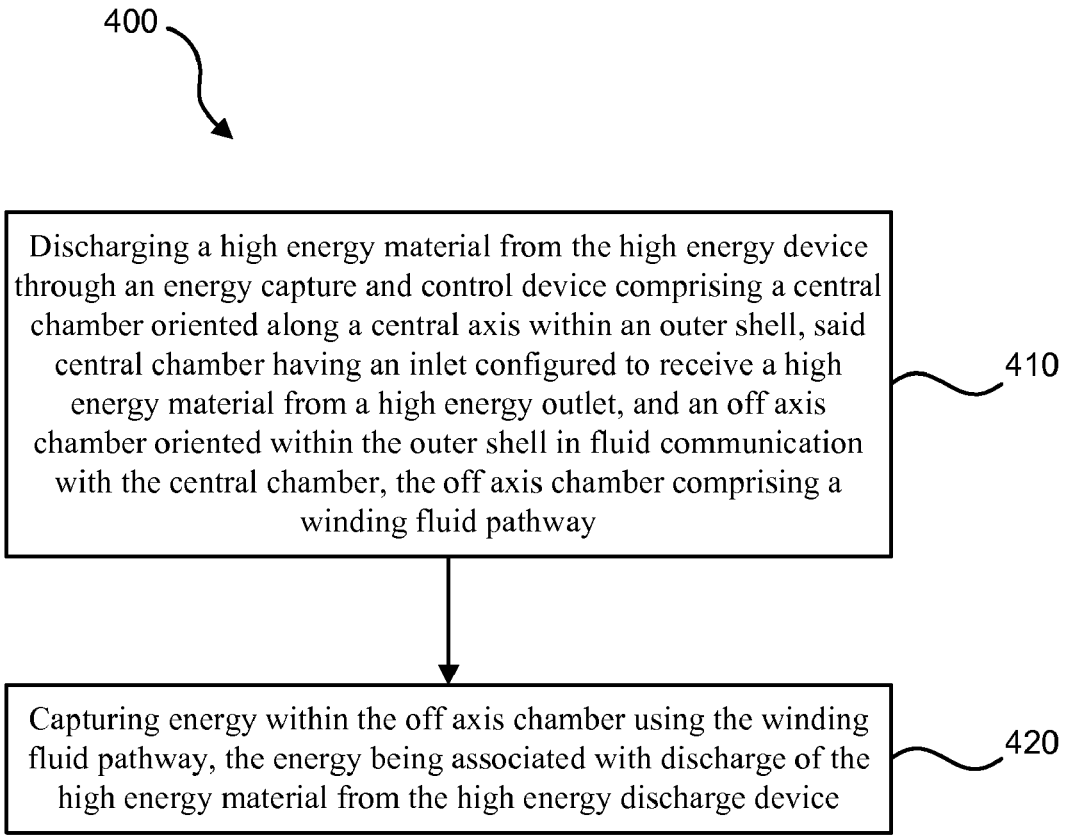
FIG. 17 is a flow diagram of a method for energy capture and control from a high energy device in accordance with an example of the present technology.

Referring now to FIG. 17, a method 400 is provided for energy capture and control from a high energy device. The method can include discharging 410 a high energy material from the high energy device through an energy capture and control device which includes a central chamber oriented along a central axis within an outer shell. The central chamber can have an inlet for receiving a high energy material from a high energy outlet and an off axis chamber oriented within the outer shell in fluid communication with the central chamber. The off axis chamber can have therein a winding fluid pathway. The method can further include capturing 420 energy within the off axis chamber using the winding fluid pathway, the energy being associated with discharge of the high energy material from the high energy discharge device.

The devices can generally perform well for a large number of cycles, periodic optional cleaning can remove film, debris or other material which collects within the device. Non-limiting examples of suitable cleaning protocols can include sonication, solvent immersion, disassembly, and high pressure air. Although specific acoustic suppression performance can vary depending on the specific configuration and options included, these designs have shown up to 15% sound reduction. The resulting devices can dramatically suppress acoustic impact of high energy materials with minimal maintenance and high cycle life.

Although the devices described are exemplified in terms of firearms, and more specifically in terms of silencer devices for sniper rifles used in counter-terrorism efforts, other applications can also benefit from these configurations. For example, high velocity/high temperature gases, projectiles, heat or sound energy can be suppressed using these devices. By adjusting the chamber configurations (e.g. number or shapes of tubes, deflectors, windings, etc) the back pressure can be tuned for a particular application. Most often, the device also does not adversely affect performance of the host mechanism to which it is attached.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. An energy capture and control device, comprising:

a) a central chamber oriented along a central axis within an outer shell, said central chamber having an inlet configured to receive a high energy material from a high energy outlet;

b) a common off axis chamber oriented within the outer shell in fluid communication with the central chamber and having a fluid outlet and multiple internal walls defining a serpentine fluid pathway which is at least one of axially serpentine and radially serpentine and which dissipates energy transferred from the high energy material; and c) a plurality of deflectors oriented in series along the central axis of the central chamber and configured to deflect the energy from the high energy material to the common off axis chamber.

2. The device of claim 1, wherein the common off axis chamber comprises a plurality of sub-chambers defined by the plurality of deflectors, each with the radially serpentine fluid pathway, and wherein the radially serpentine fluid pathways of each of the deflectors are axially non-linearly interconnected along an outermost portion of the plurality of sub-chambers.

3. The device of claim 1, wherein the central chamber further comprises a locking block oriented at the inlet, said locking block having an engagement surface configured to attach to the high energy outlet and a hollow interior along the central axis, said hollow interior having a reducing throat portion and a flared outlet.

4. The device of claim 1, wherein the plurality of deflectors each comprise a frustoconical shape having a hollow interior along the central axis and a flared exit portion.

5. The device of claim 4, wherein the plurality of deflectors include a primary deflector, a secondary deflector, and at least one tertiary deflector.

6. The device of claim 5, wherein the fluid communication between the common off axis chamber and the central chamber occurs only at the primary deflector, the secondary deflector and a first tertiary deflector.

7. The device of claim 5, wherein at least one tertiary deflector is at least partially engaged within the flared exit portion of an adjacent deflector.

8. The device of claim 4, wherein the plurality of deflectors span substantially the entire central axis along the central chamber.

9. The device of claim 1, wherein the multiple internal walls are formed to produce a radially serpentine fluid pathway.

10. The device of claim 1, wherein the multiple internal walls are formed by multiple concentric tubes having progressively larger diameters so as to form annular spaces between each adjacent tube, and having alternating ends offset so as to produce the axially serpentine fluid annular pathway.

11. The device of claim 10, wherein the multiple concentric tubes include an innermost tube which includes orifices oriented to allow fluid to pass from the central chamber into a first annular space adjacent the innermost tube and through the annular spaces of progressively larger diameter.

12. The device of claim 11, wherein the annular spaces further include a helical wall oriented within at least one of the annular spaces to direct fluids along a helical path within the at least one annular space.

13. The device of claim 12, wherein the helical wall has a quadrilateral cross-section or a circular cross-section.

14. The device of claim 12, wherein the helical wall has a winding ratio (windings:diameter) of about 3:1 to about 8:1.

15. The device of claim 1, wherein the common off axis chamber further includes an annular dampening chamber oriented about the central chamber and being filled with an energy absorbent material.

16. The device of claim 15, wherein the dampening chamber is oriented adjacent the outer shell.

17. The device of claim 15, wherein the energy absorbent material is selected from the group consisting of powder tungsten filament, heavy metal powder, graphite, polymer, aluminum, stainless steel, carbon steels, iron, copper, tantalum, titanium, vanadium, chromium, zirconium, carbides of these, alloys of these, and combinations thereof.

18. The device of claim 1, wherein the outer shell includes an end cap assembly at an outlet end of the central chamber and which allows fluid to escape from the common off axis chamber through the fluid outlet, the fluid outlet being only accessible to the fluid in the common off axis chamber.

19. An energy capture and control device, comprising:

a) a central chamber oriented along a central axis within an outer shell, said central chamber having an inlet configured to receive a high energy material from a high energy outlet;

b) a common off axis chamber oriented within the outer shell in fluid communication with the central chamber via a plurality of orifices and further includes a fluid outlet, the common off axis chamber comprising a serpentine fluid pathway which is at least one of axially serpentine and radially serpentine; and c) a plurality of deflectors oriented in series along the central axis of the central chamber, wherein a position of multiple individual deflectors of the plurality of deflectors corresponds with the individual orifices of the plurality of orifices to the common off axis chamber.

20. The device of claim 19, wherein the common off axis chamber further comprises at least one helical wall defining the axially serpentine fluid pathway, the at least one helical wall being configured to produce an axially serpentine fluid pathway which helically spirals around the central chamber and which dissipates energy transferred from the high energy material.

21. The device of claim 19, further comprising multiple internal walls defining the axially serpentine fluid pathway, the multiple internal walls being formed by multiple concentric tubes having progressively larger diameters so as to form annular spaces between each adjacent tube, and having alternating ends offset so as to produce a serpentine fluid annular pathway.

22. A method for energy capture and control from a high energy device, comprising:

a) discharging a high energy material from the high energy device through an energy capture and control device comprising a central chamber oriented along a central axis within an outer shell, said central chamber having an inlet configured to receive a high energy material from a high energy outlet, and a common off axis chamber oriented within the outer shell in fluid communication with the central chamber, the common off axis chamber comprising an axially serpentine fluid pathway and a fluid outlet; and b) capturing energy within the common off axis chamber via a plurality of orifices from the central chamber using the axially serpentine fluid pathway, the energy being associated with discharge of the high energy material from the high energy discharge device.

* * * * *